US006503063B1

(12) United States Patent
Brunsell

(10) Patent No.: US 6,503,063 B1
(45) Date of Patent: Jan. 7, 2003

(54) PORTABLE AIR MOVING APPARATUS

(76) Inventor: Willis Brunsell, 46 La Cerra Dr., Rancho Mirage, CA (US) 92270

( * ) Notice: Subject to any disclaimer, the term of this patent is extended or adjusted under 35 U.S.C. 154(b) by 0 days.

(21) Appl. No.: 09/823,074

(22) Filed: Mar. 29, 2001

Related U.S. Application Data

(60) Provisional application No. 60/208,887, filed on Jun. 2, 2000.

(51) Int. Cl.[7] ..... F04B 53/00

(52) U.S. Cl. ..... 417/234; 417/411; 417/410.1; 417/423.3

(58) Field of Search ..... 417/234, 411, 417/410.1, 423.1

(56) References Cited

U.S. PATENT DOCUMENTS

| | | | | |
|---|---|---|---|---|
| 2,294,399 A | | 9/1942 | Fukal | |
| 2,650,019 A | | 8/1953 | Lautner et al. | |
| 2,747,791 A | | 5/1956 | Edmonds | |
| 2,850,228 A | | 9/1958 | Rowley | |
| 3,733,836 A | * | 5/1973 | Corini | 62/3.61 |
| 3,963,382 A | | 6/1976 | Patton | |
| 4,800,803 A | * | 1/1989 | Farmont | 98/2.14 |
| D314,048 S | | 1/1991 | Leon, Jr. | |
| 5,685,165 A | * | 11/1997 | Bigelow, Jr. | 62/420 |
| 6,146,108 A | * | 11/2000 | Mullendore | 417/234 |

* cited by examiner

*Primary Examiner*—Charles G. Freay
*Assistant Examiner*—Michael K. Gray
(74) *Attorney, Agent, or Firm*—Gene Scott-Patent Law & Venture Group

(57) ABSTRACT

A portable air moving apparatus for providing personal air cooling includes a container with open top and supported by plural wheels attached thereto. The container encloses electrical components including a battery, a radial flow air moving device, and a switch. These components are interconnected by electrical conductors such that the switch can make and break a circuit for driving the air moving device with the battery. A removable container lid provides an aperture for receiving an air exhaust from the air moving device which is then directed toward an individual to provide cooling. The container lid is adapted for being set to allow air flow into the container so as to feed the air moving device.

5 Claims, 4 Drawing Sheets

PORTABLE AIR MOVING APPARATUS

The present invention claims the priority date of a prior filed provisional patent application having Ser. No. 60/208,887 and an official filing date of Jun 2, 2000 and which discloses substantially the same material as described herein.

BACKGROUND OF THE INVENTION

1. Field of the Invention

This invention relates generally to air handling equipment and more particularly to a compact air handling apparatus with portable, rechargeable power supply.

2. Description of Related Art

The following art defines the present state of this field:

Leon, Jr., U.S. Pat. No. D314,048 provides the ornamental design for a portable, height adjustable battery-powered fan.

Fukal, U.S. Pat. No. 2,294,399 describes an electric fan enclosure for supporting an electric fan of the circulatory type and its motor, said fan enclosure including a base for supporting the motor and the electric fan, a plurality of substantially horizontally disposed molded hoops stacked upon the base for enclosing the motor and the fan, each of said hoops having a tear-drop shaped transverse cross sectional area, the longitudinal axis of each transverse sectional area forming an acute angle with the diameter of the hoop so that the hoops have an angularly disposed arcuate surfaces, a plurality of projections integral with the hoops, said projections holding the hoops in spaced relation from each other, and means for holding the hoops and the base as a unitary structure.

Lautner et al., U.S. Pat. No. 2,650,019 describes a fan structure having a support, a tubular shroud, a circulation deflector carried thereby in spaced relation to one end thereof, said tubular shroud being pivotally mounted on said support for its tube axis to extended either substantially vertically or substantially horizontally, a fan motor pivotally mounted within said shroud for its shaft axis to extend either substantially vertically or substantially horizontally, a fan on the shaft of said motor, and a geared connection between said support and said motor for turning said motor on its pivotal axis relative to said shroud as a result of turning said shroud on its pivotal axis relative to said support.

Edmonds, U.S. Pat. No. 2,747,791 describes a hassock-type air circulator having an upstanding support with two opposed side members, a supporting structure pivotally mounted on said side members, a pair of arms each having one end rigidly connected to said supporting structure, and air deflector carried by said arms, louvers carried by said arms adjacent to said air deflector, a fan-motor assembly pivotally mounted between the other ends of said arms, said fan-motor assembly having a shaft mounted therein, a fan in said assembly mounted on said shaft rotable on an axis normal to the axis of the said pivotally-mounted fan-motor assembly, means positioned adjacent the fan-motor assembly for maintaining the fan-motor assembly in any selected position, and means positioned on the supporting structure for the releasably securing the supporting structure in non-rotable position with respect to said upstanding support.

Rowley, U.S. Pat. No. 2,850,228 describes a portable battery-operated blower unit comprising a battery housing adapted to serve as a base for said blower, said housing having a cover at one end for providing access thereto, a centrifugal blower pivotally mounted on the top of said housing and at one side thereof, said blower including a housing having an axial intake and a tangential exhaust, an impeller in said housing rotatable mounted on a horizontal axis, and electric motor having a casing secured to said blower housing and a drive shaft mechanically connected to said impeller for driving same, said motor extending from the side of the blower housing as to substantially overlie said batter housing, and annular conductor secured within said battery housing at one end thereof but being insulated therefrom for contacting one terminal of a battery carried in said battery housing, a disk-shaped conductor inside of said annular conductor secured in insulating relationship to said one end of the battery housing, one of said conductors being electrically connected to one terminal of said motor, said other terminal of said motor being electrically connected to said battery housing, and a switch electrically connected with said battery housing for electrically connecting said battery housing and said other conductor.

Patton, U.S. Pat. No. 3,963,382 describes a portable air circulating fan, especially a high velocity fan in which a rotary air impeller is mounted on the shaft of an electric motor while a guard is provided which encloses the impeller and may enclose part or all of the motor, and which guard is formed into separable forward and rearward sections. The electric motor for the fan is supported on one of the guard sections near the center, especially the rearward guard section, while a support frame is provided for the fan having a base portion and a pair of spaced upstanding legs which are connected to the sides of the guard, and about which points of connection the fan is tiltable. Advantageously, the legs are also connected to the rearward guard section but may, alternatively, be connected to the forward guard section. In this manner the rotating air impeller is guarded at all times. The guard sections each comprise a center ring member and extending substantially radially from the center ring are wires which incline radially outwardly and inwardly to a peripheral outer ring. The radial wires may be provided with strengthening rings if desired.

The prior art teaches the use of direct current powered air moving devices, portable electric fans, and directing and deflecting of air streams from air movers, but does not teach the use of an enclosed, wheeled, air mover with AC current operation and rechargeable battery operated power supply. The present invention fulfills these needs and provides further related advantages as described in the following summary.

SUMMARY OF THE INVENTION

The present invention teaches certain benefits in construction and use which give rise to the objectives described below.

The present invention is a portable air moving apparatus for providing personal air cooling and includes a container with open top and supported by plural wheels attached under the container. The container encloses electrical components including a battery, a radial flow air moving device, and a switch. These components are interconnected by electrical conductors such that the switch can make and break a circuit for driving the air moving device with the battery. A removable container lid provides an aperture for receiving an air exhaust from the air moving device which is then directed toward an individual to provide cooling. The container lid is adapted for being set to allow air flow into the container so as to feed the air moving device. The invention is particularly useful at the pool and may be safely used on the pool deck.

A primary objective of the present invention is to provide an apparatus and method of use of such apparatus that provides advantages not taught by the prior art.

Another objective is to provide such an invention capable of being easily moved from place to place.

A further objective is to provide such an invention capable of operating for an extended period before being recharges.

A still further objective is to provide such an invention capable of providing portable power to generally power inaccessible areas.

A yet further objective is to provide a powered, air handling apparatus that is safe to use around a swimming pool.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description.

Figure 1:
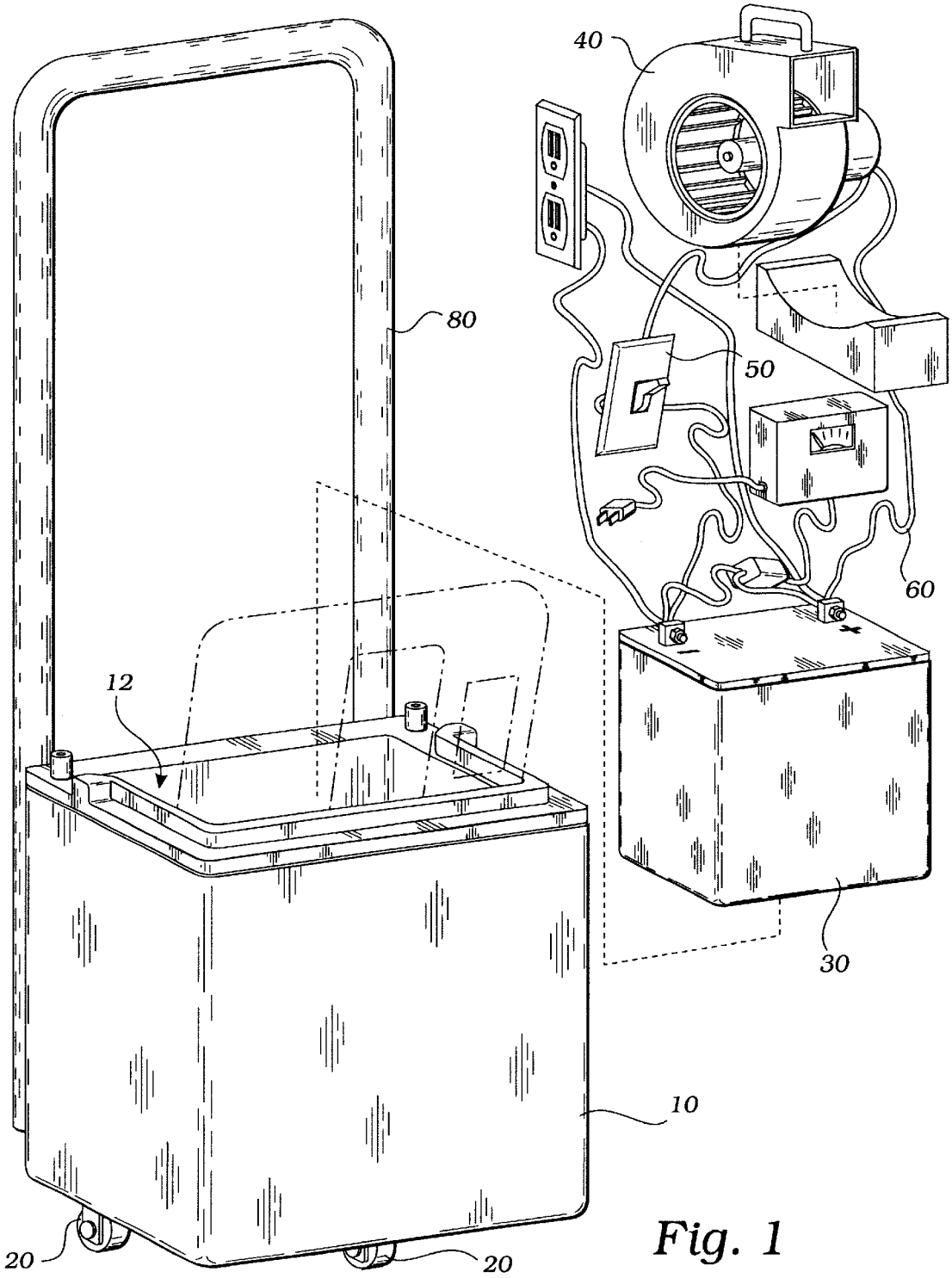
FIG. 1 is an exploded perspective view of the preferred embodiment of the invention.
Figure 2:
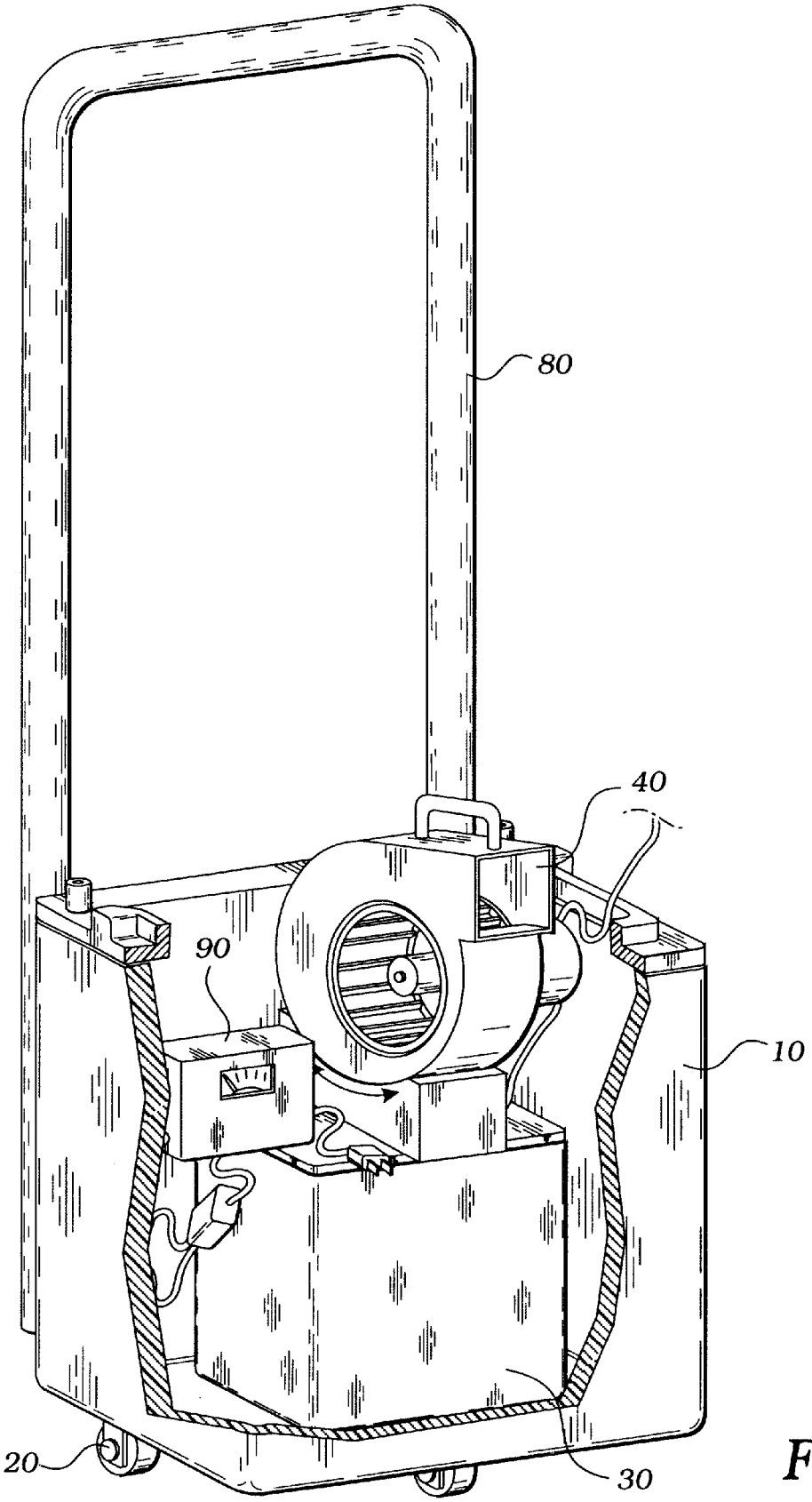
FIG. 2 is a perspective cutaway view thereof as assembled.
Figure 3:
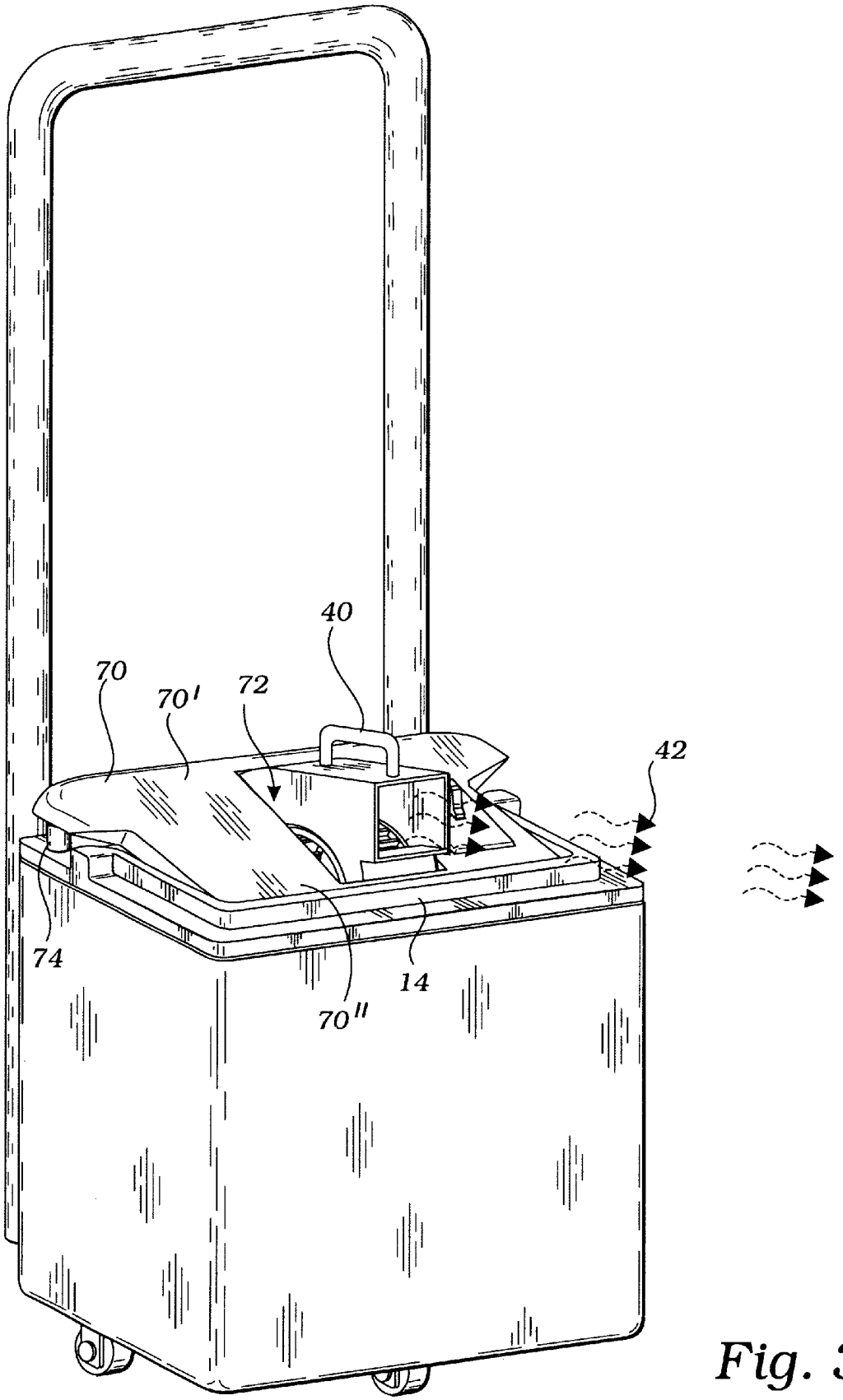
FIG. 3 is a perspective view thereof in typical operation.

The invention is a portable air moving apparatus for providing personal air cooling. It comprises a container 10, with open top 12 and is supported by plural wheels 20 attached to the bottom of the container 10. The container 10 encloses electric components including: battery 30, an air-moving device 40 preferably of the radial flow type, as shown in FIG. 1, and a switch 50. The components are interconnected by electrical conductors 60, i.e., insulated copper wires, such that the switch 50 is enabled for making and breaking a circuit, as best seen in FIG. 1, for driving the air moving device 40 with the battery 30. A removable container lid 70 provides an aperture 72 for receiving an air exhaust 42 from the air-moving device 40. The container lid 70 is positionable for enabling an air flow into the container 10. This adaptation is accomplished using propping spacers 74, as shown in FIG. 3. One end 70' of the lid 70 is propped open by spacers 74 so that air may flow into the container 10 between the one end 70' and a ridge 14 extending upwardly around the open top 12. The lid 70 is maintained in the propped open attitude by resting an opposing end 70" against the ridge 14 for support.

Preferably, the air moving device 40 protrudes upwardly through the aperture 72 of the container lid 70 as shown in FIG. 3 so that the air exhaust 42 may be directed beneficially while the appearance of the invention is not degraded, and the noise produced by the air moving device 40 is contained.

Figure 5:
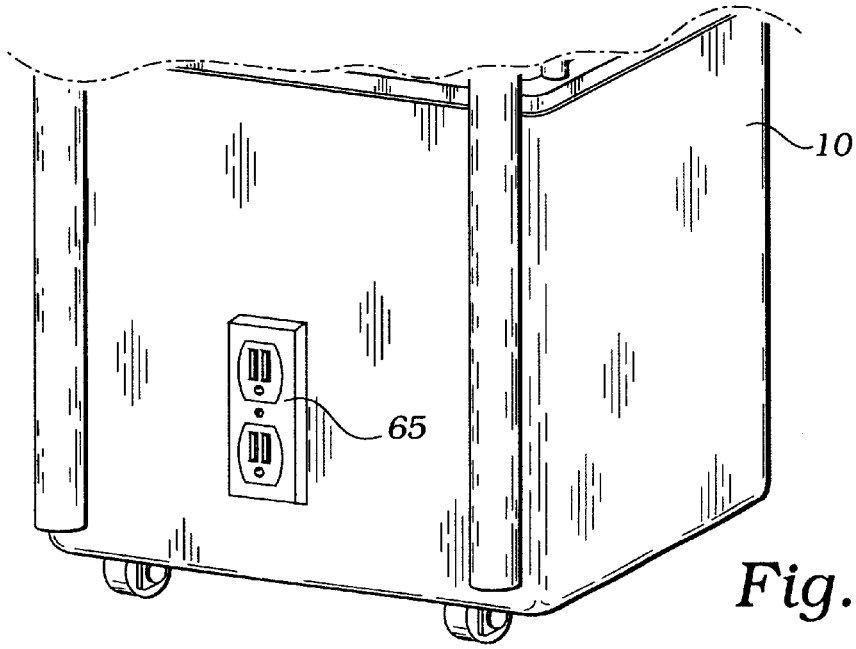
FIG. 5 is a partial perspective view thereof showing utility outlets of the invention.

Preferably, the circuit further comprises an electrical outlet 65 mounted on the container 10 and accessible from its exterior as shown in FIG. 5. This outlet 65 may power an air pump to inflate water toys, drive an external fan, a misting device or any number of other power driven items normally used at poolside.

Figure 4:
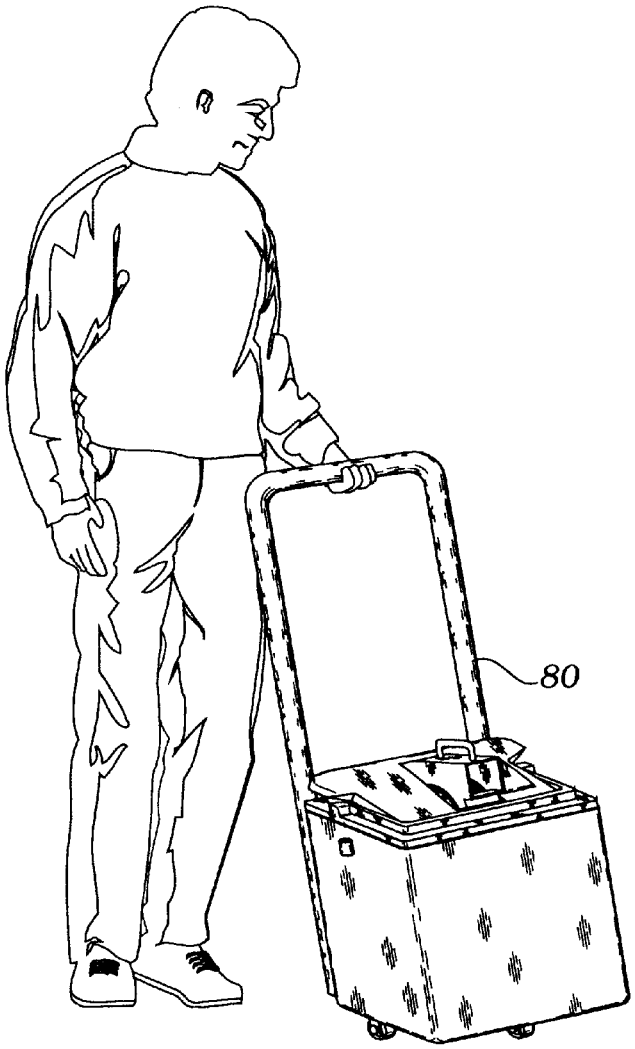
FIG. 4 is perspective view thereof shown being moved.

Preferably, the apparatus further comprises a handle 80 which is of such extent and position as to enable the movement of the container 10 by a standing individual, as shown in FIG. 4.

The circuit may further comprise a recharging device 90 of any standard type for replenishing depleted charge in the battery 30, and is interconnected for such service as shown in FIG. 1. Such devices are well known and typically draw current from an AC socket while converting such current to a DC type by first stepping the voltage down from 115 volts to about 12 volts AC and then rectifying this AC voltage to a DC voltage through a rectifying circuit. This is well known in the art and therefore will not be further defined or shown in the present description and drawings.

The container 10 is preferably made of a sound insulation material such as polystyrene or an equivalent material so that the noise of the air moving device 40 is muffled.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A portable air moving apparatus for providing personal air cooling which comprises: a container with an open top and supported by plural wheels attached to the container; the container enclosing electric components including: a battery, an air moving device, and a switch, the components interconnected by electrical conductors such that the switch is enabled for making and breaking a circuit for driving the air moving device; a removable container lid providing an aperture for receiving an air exhaust from the air moving device, and a ridge positioned around the open top of the container, the ridge connected to propping spacers functionally supporting the lid in a propped open attitude at one end thereof and supported by the ridge at an opposing end thereof, thereby enabling air to be drawn into the container between the propped open one end of the lid and the ridge.

2. The apparatus of claim 1 wherein the air moving device protrudes through the container lid.

3. The apparatus of claim 1 wherein the circuit further comprises an electrical outlet accessable from the exterior of the container.

4. The apparatus of claim 1 further comprising a handle of such extent and position as to enable the movement of the container by a standing individual.

5. The apparatus of claim 1 wherein the circuit further comprises a recharging device for replenishing depleted charge in the battery.

* * * * *